US008947307B2

(12) United States Patent
Lo

(10) Patent No.: US 8,947,307 B2
(45) Date of Patent: Feb. 3, 2015

(54) SHARK FIN TYPE CAR ANTENNA ASSEMBLY

(71) Applicant: Shan-Gow Lo, Tainan (TW)

(72) Inventor: Shan-Gow Lo, Tainan (TW)

(73) Assignee: Jebsee Electronics Co., Ltd., Tainan (TW)

( * ) Notice: Subject to any disclaimer, the term of this patent is extended or adjusted under 35 U.S.C. 154(b) by 222 days.

(21) Appl. No.: 13/723,249

(22) Filed: Dec. 21, 2012

(65) Prior Publication Data

US 2014/0176374 A1 Jun. 26, 2014

(51) Int. Cl.
*H01Q 1/32* (2006.01)

(52) U.S. Cl.
CPC ..... *H01Q 1/3275* (2013.01)
USPC ..... 343/713; 343/711

(58) Field of Classification Search
CPC ..... H01Q 1/32; H01Q 1/3275
USPC ..... 343/713, 711
See application file for complete search history.

(56) References Cited

U.S. PATENT DOCUMENTS

| | | | | |
|---|---|---|---|---|
| 8,519,897 | B2 * | 8/2013 | Duzdar et al. | 343/713 |
| 2012/0001811 | A1 * | 1/2012 | Yoo et al. | 343/713 |
| 2012/0188143 | A1 * | 7/2012 | Yang et al. | 343/872 |
| 2012/0274519 | A1 * | 11/2012 | Chakam et al. | 343/702 |
| 2012/0326935 | A1 * | 12/2012 | Kang et al. | 343/713 |

* cited by examiner

*Primary Examiner* — Hoang V Nguyen
(74) *Attorney, Agent, or Firm* — Alan D. Kamrath; Kamrath IP Lawfirm, P.A.

(57) ABSTRACT

A car antenna assembly includes an outer cover, an antenna unit, a fixing seat, a locking bar, a control board, and a base. The antenna unit is made of a metallic strip which is bent freely to form a plurality of antenna elements which are connected successively. The outer cover covers the antenna unit and the fixing seat. Thus, the height of the antenna elements is increased gradually from the front end toward the rear end of the antenna unit, while the antenna elements have a constant spacing so that the bandwidth of the antenna elements is increased so as to increase the receiving effect of the AM and FM signals. The car antenna assembly has a shark fin shape to reduce the air drag and air shear noise.

5 Claims, 11 Drawing Sheets

SHARK FIN TYPE CAR ANTENNA ASSEMBLY

BACKGROUND OF THE INVENTION

1. Field of the Invention

The present invention relates to an antenna assembly and, more particularly, to a shark fin type car antenna assembly.

2. Description of the Related Art

A conventional car antenna 11 in accordance with the prior art shown in FIG. 1 is mounted on the top of a car 1 and comprises a movable receiving rod 110 protruding outward from the top of the car 1. Thus, the car antenna 11 can receive a wireless signal, such as the AM and FM signals, by the receiving rod 110. The receiving rod 110 of the car antenna 11 is pivoted to change its inclined angle so as to adjust the strength of the received wireless signal. However, the receiving rod 110 of the car antenna 11 protrudes outward from the top of the car 1 so that the receiving rod 110 of the car antenna 11 is easily disturbed by an air pressure or drag when the car 1 is driven at a higher speed, thereby decreasing the quality of the received signal. In addition, the receiving rod 110 of the car antenna 11 has a determined length so that when the receiving rod 110 of the car antenna 11 is impacted by a lower obstruction above the car 1, the receiving rod 110 of the car antenna 11 is easily deformed or broken due to a severe collision of the obstruction, thereby decreasing the receiving function of the car antenna 11, and thereby shortening the lifetime of the car antenna 11. Further, the receiving rod 110 of the car antenna 11 produces an air shear noise when the car 1 is driven at a higher speed, thereby easily causing an uncomfortable sensation to the driver in the car 1.

BRIEF SUMMARY OF THE INVENTION

In accordance with the present invention, there is provided a shark fin type car antenna assembly, comprising an outer cover, an antenna unit, a fixing seat, a locking bar, a control board, and a base. The antenna unit is locked and positioned in the fixing seat. The fixing seat is connected with the base. The outer cover closes the fixing seat and the base. The antenna unit is made of a metallic strip which is bent freely to form a plurality of antenna elements which are connected successively. Each of the antenna elements has a trapezium shape. The antenna elements have a height which is increased gradually from the front end of the antenna unit toward the rear end of the antenna unit. The fixing seat is provided with a plurality of retaining grooves for mounting and positioning the antenna unit. The antenna elements are inserted into the retaining grooves of the fixing seat. The antenna elements are spaced equally from each other, with a constant spacing being defined between any two of the antenna elements. The locking bar is locked onto the fixing seat and presses a bottom of each of the antenna elements to lock the antenna elements of the antenna unit onto the fixing seat. The outer cover covers the antenna unit and the fixing seat. The fixing seat has a periphery provided with a plurality of positioning holes, and the outer cover has an interior provided with a plurality of positioning tubes extended through the positioning holes of the fixing seat and locked onto the base, so that the outer cover is locked onto the base, and the fixing seat is positioned between the outer cover and the base.

The primary objective of the present invention is to provide a shark fin type car antenna assembly having better wireless signal receiving effect.

According to the primary advantage of the present invention, the height of the antenna elements is increased gradually from the front end toward the rear end of the antenna unit, while the antenna elements have a constant spacing to produce an enough bandwidth so that the bandwidth of the antenna elements is increased so as to increase the receiving effect of the AM and FM signals and to reach the optimum gain effect of the antenna elements.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

Figure 5:
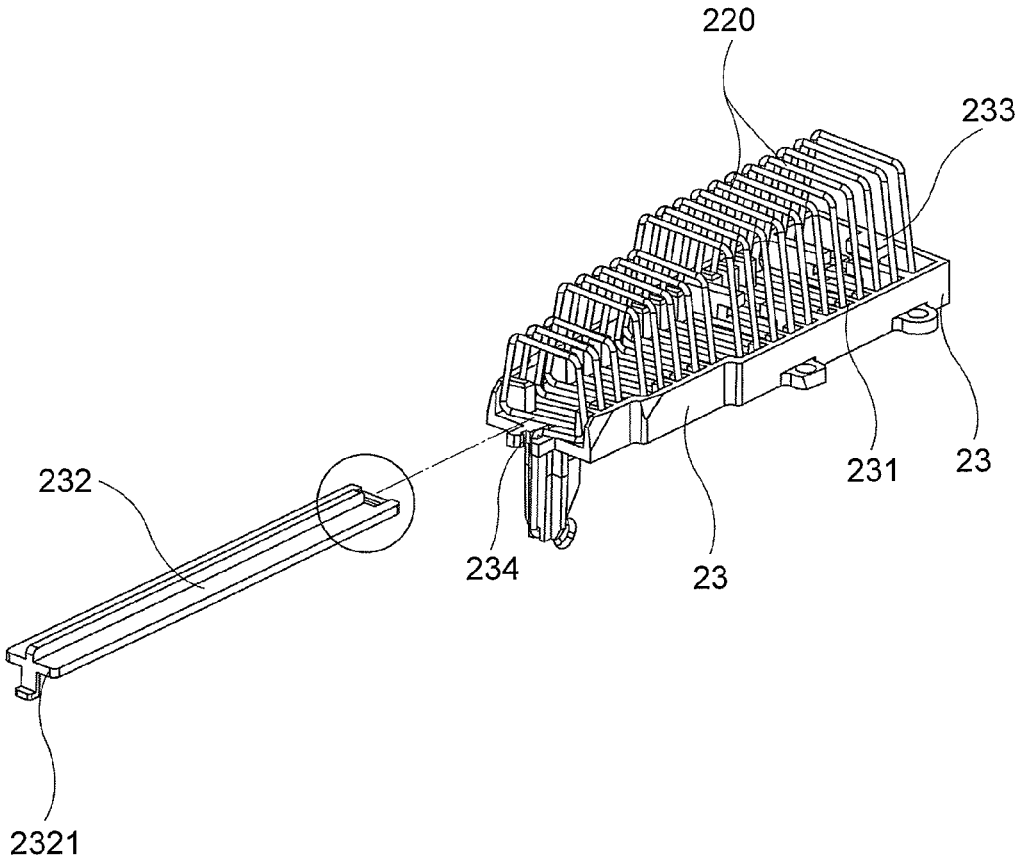
FIG. 5 is a partially perspective assembly view of the shark fin type car antenna assembly as shown in FIG. 4.
Figure 5A:
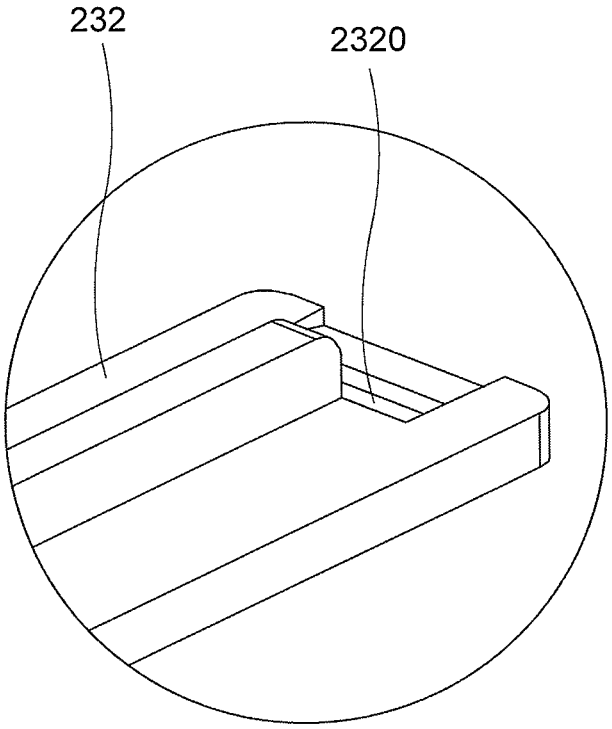

FIG. 5*a* is a locally perspective enlarged view of a locking bar of the shark fin type car antenna assembly as shown in FIG. 5.

Figure 4:
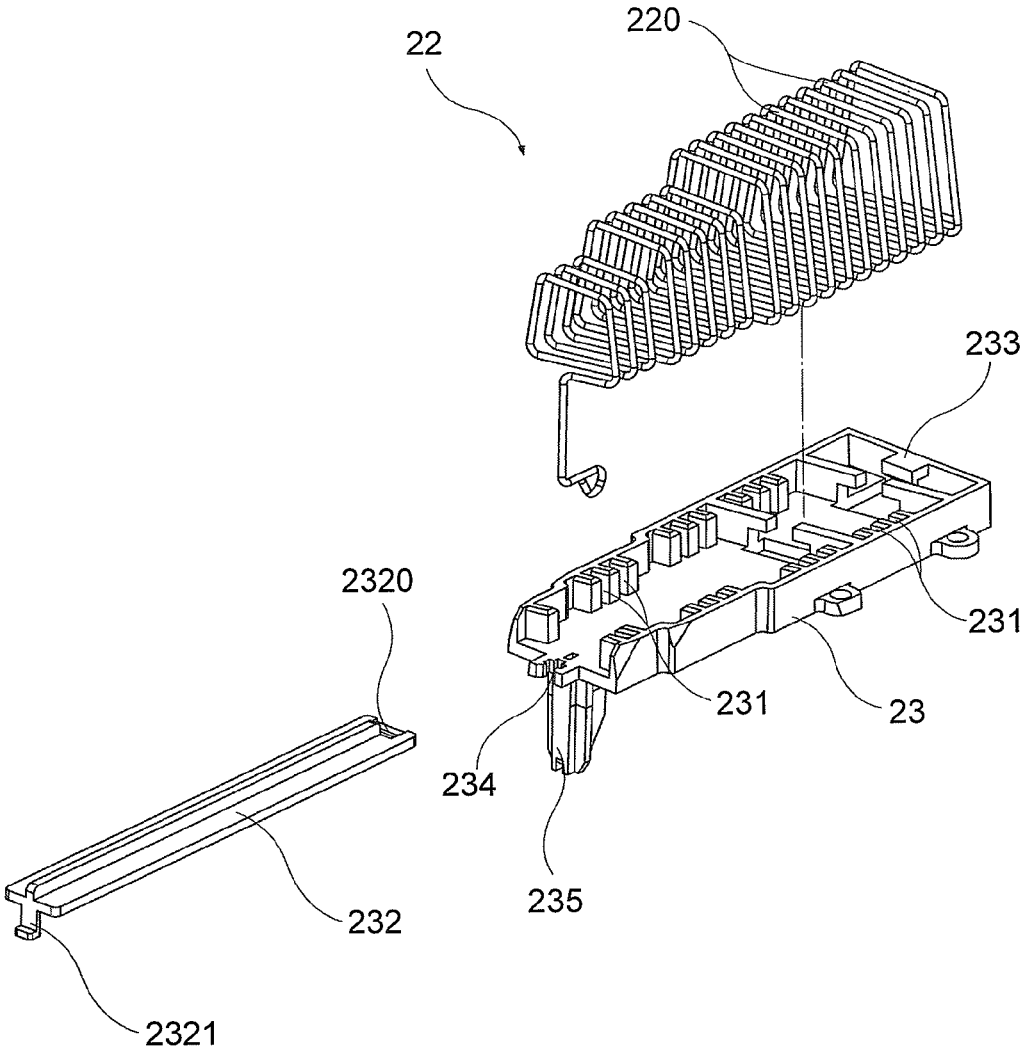
FIG. 4 is a partially exploded perspective view of the shark fin type car antenna assembly as shown in FIG. 2.
Figure 6:
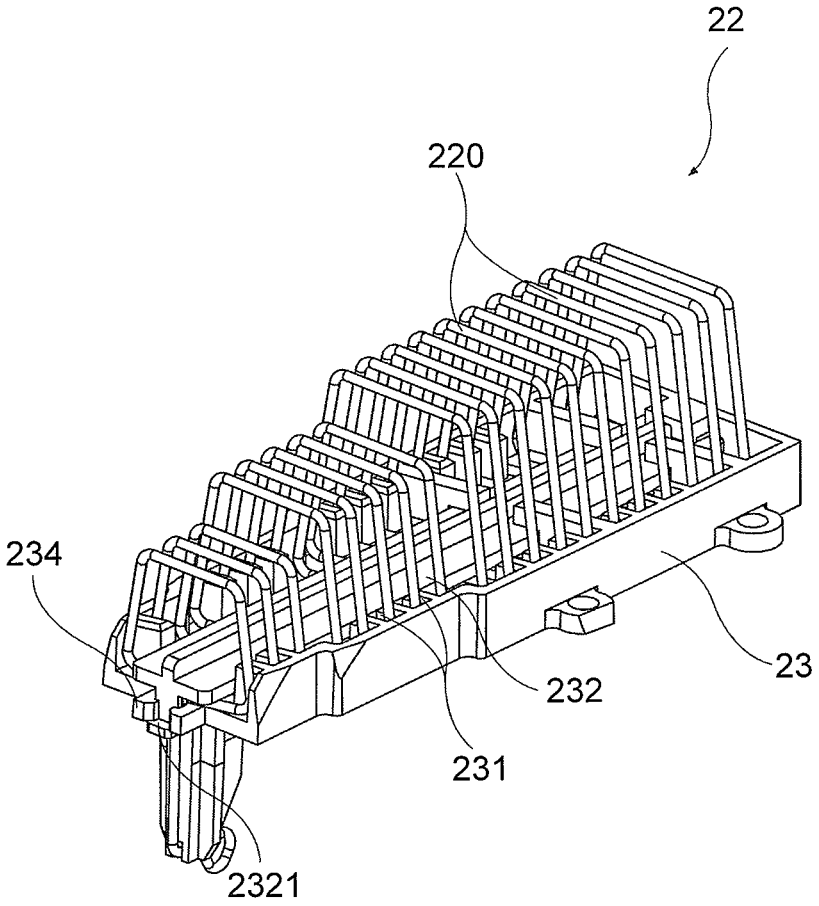

FIG. 6 is a perspective assembly view of the shark fin type car antenna assembly as shown in FIG. 4.

Figure 3:
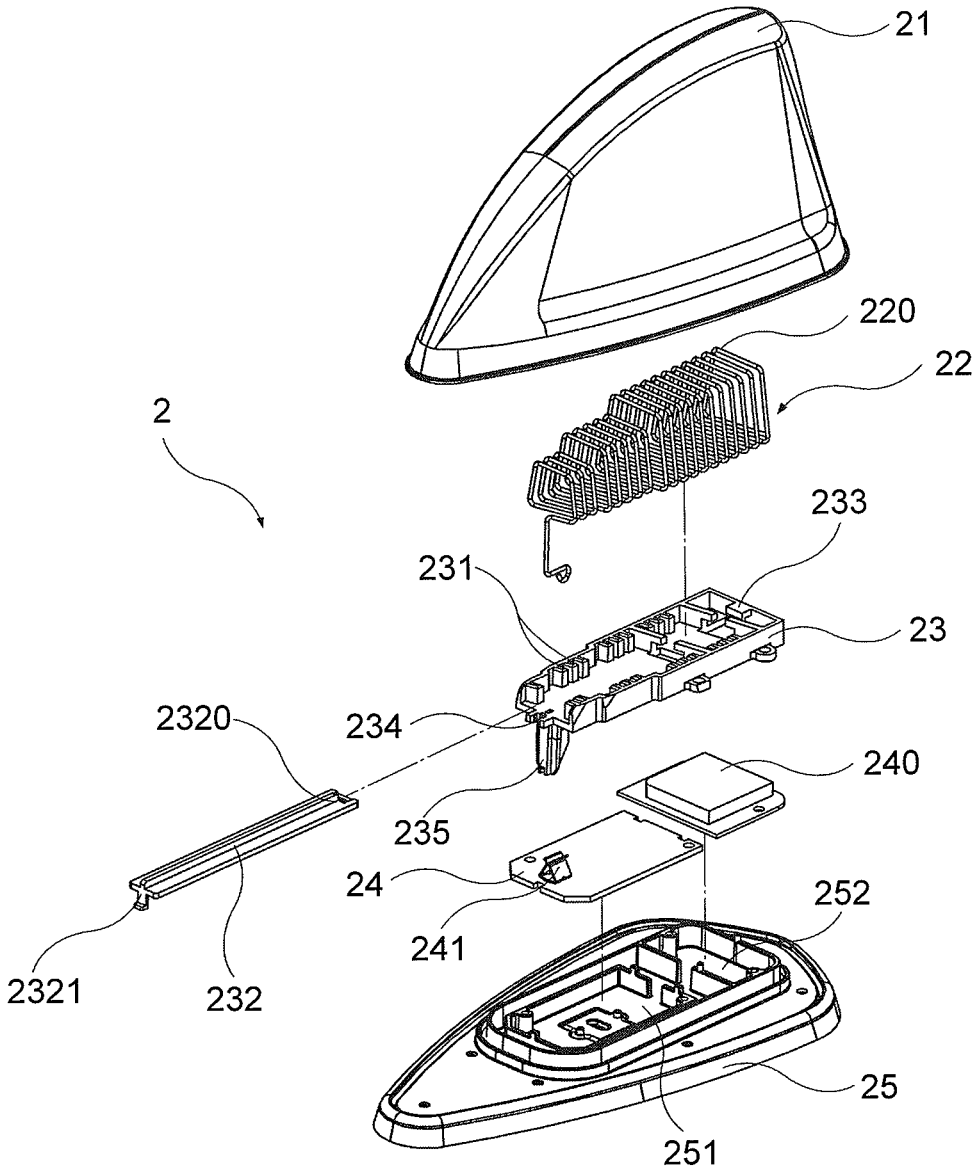
FIG. 3 is an exploded perspective view of the shark fin type car antenna assembly as shown in FIG. 2.
Figure 7:
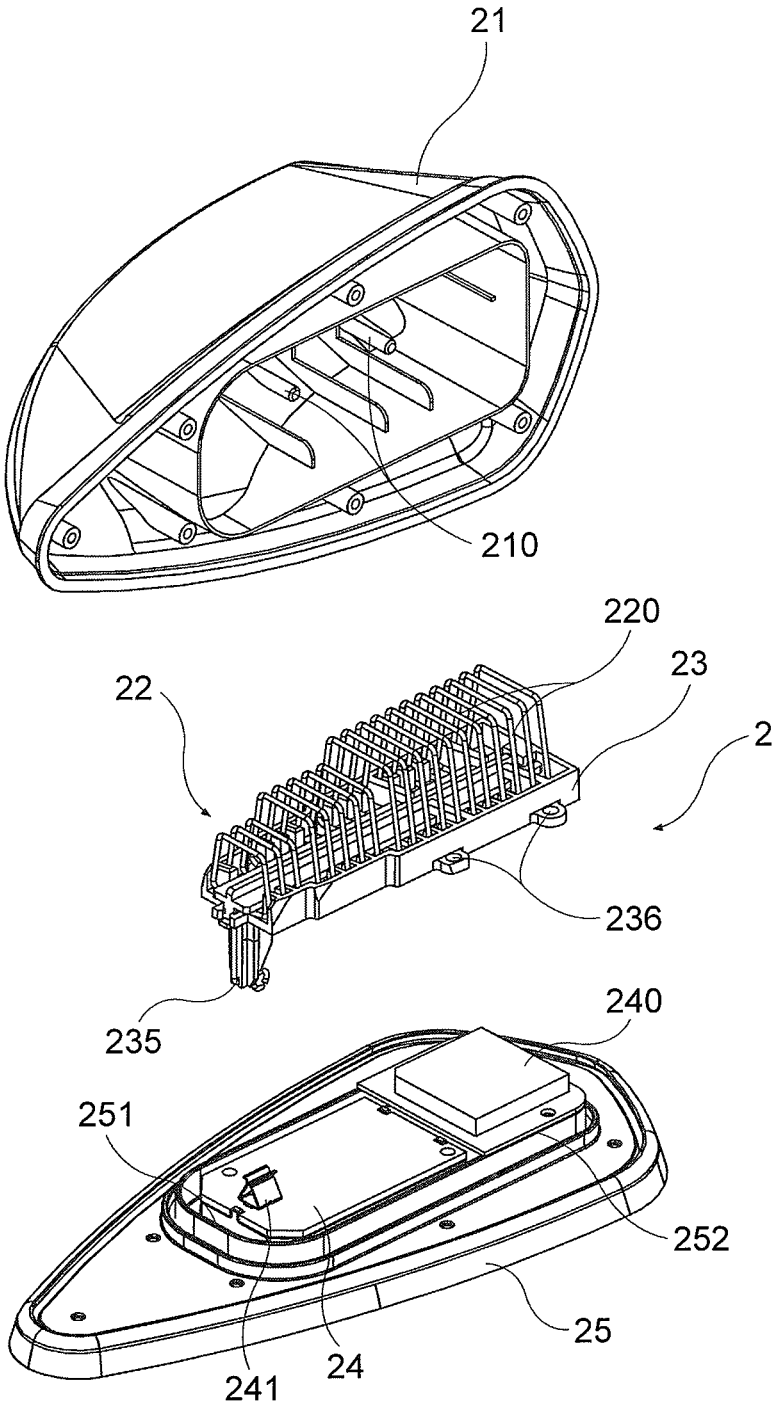

FIG. 7 is a partially perspective assembly view of the shark fin type car antenna assembly as shown in FIG. 3.

Figure 1:
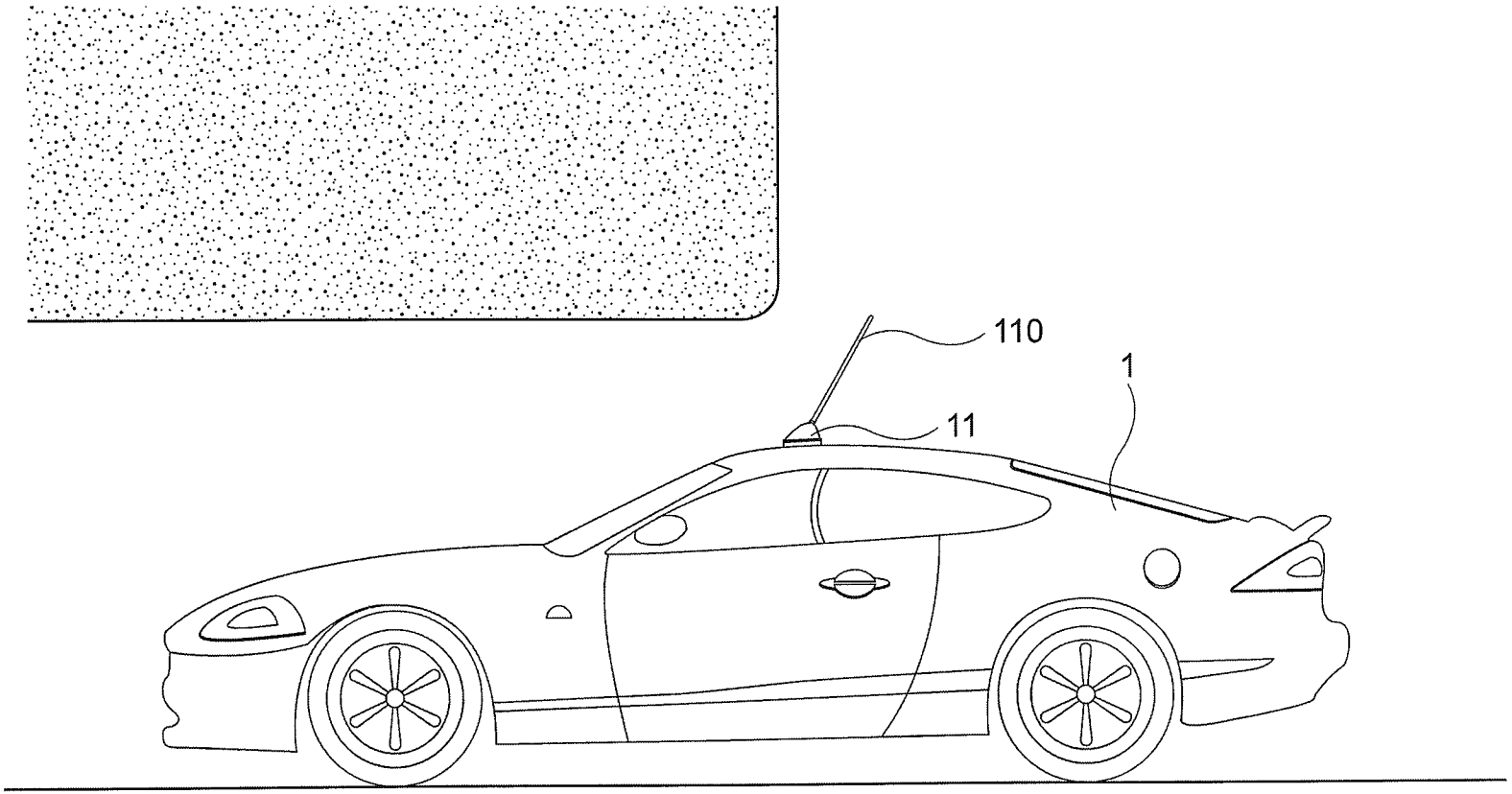
FIG. 1 PRIOR ART
FIG. 1 is a front view of a conventional car antenna in accordance with the prior art.
Figure 2:
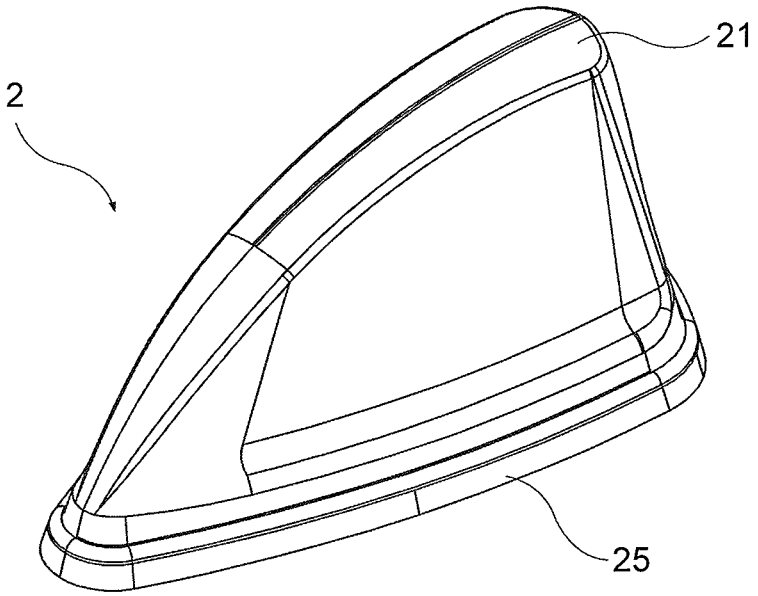
FIG. 2 is a perspective view of a shark fin type car antenna assembly in accordance with the preferred embodiment of the present invention.
Figure 8:
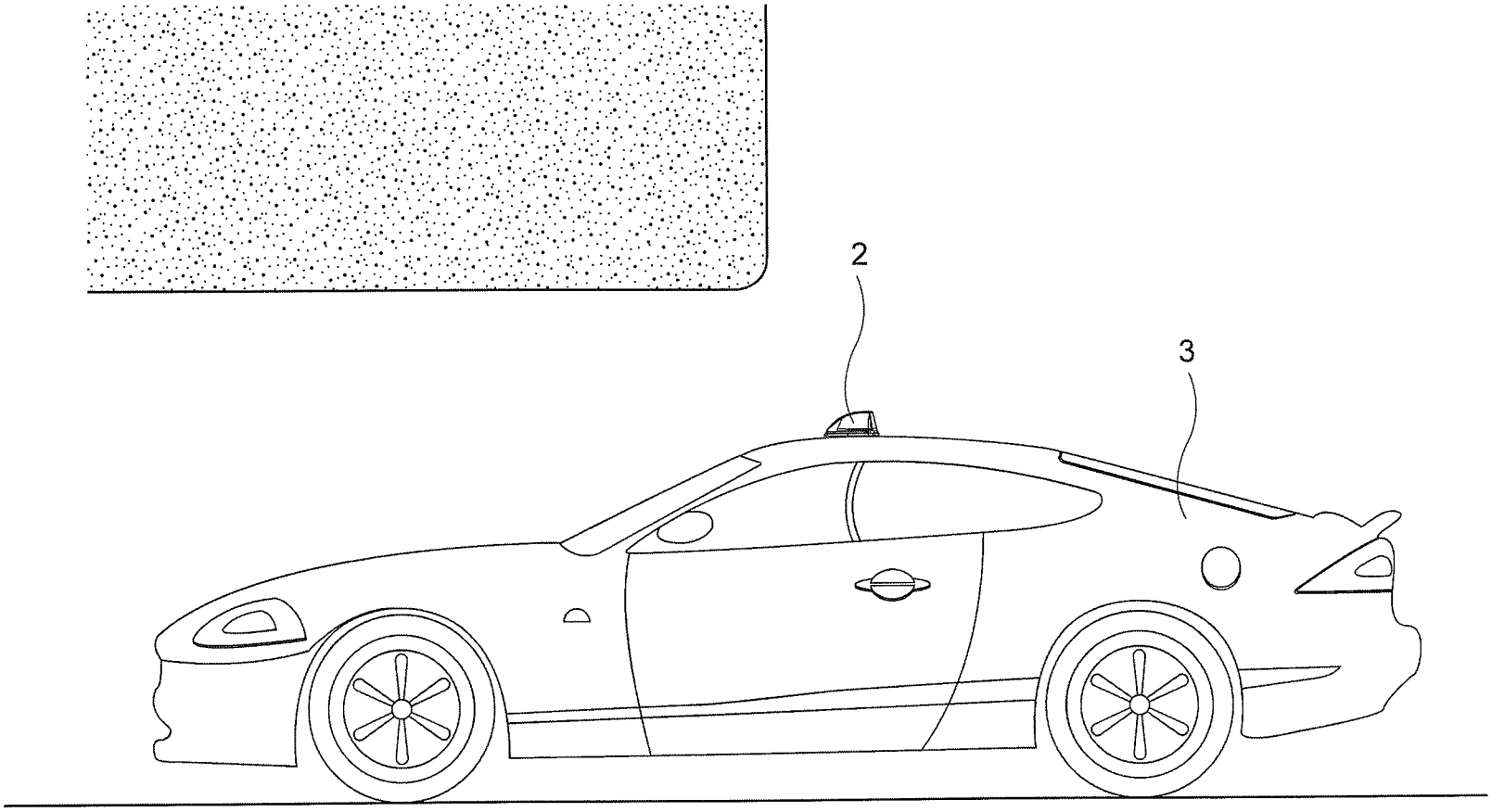

FIG. 8 is a schematic side operational view of the shark fin type car antenna assembly as shown in FIG. 2 in use.

Figure 9:
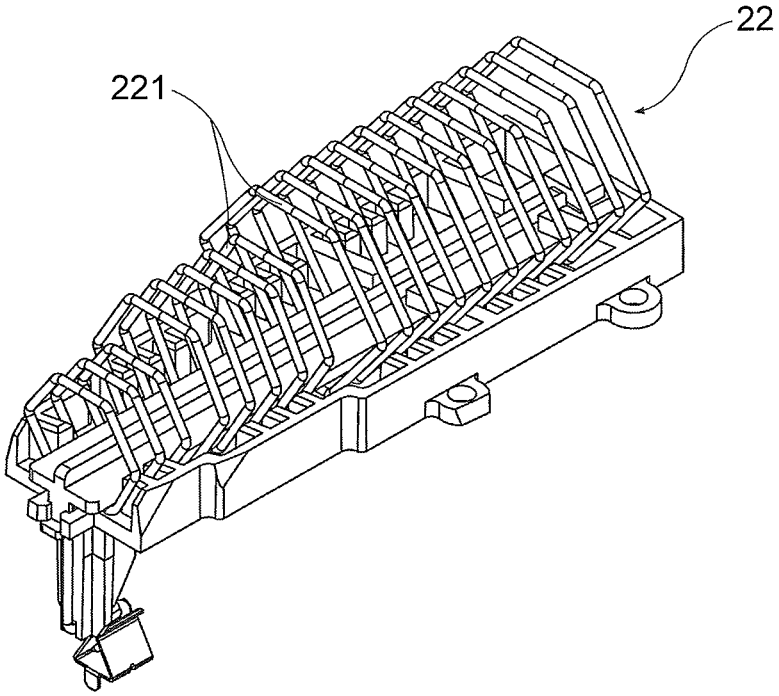

FIG. 9 is a partially perspective view of a shark fin type car antenna assembly in accordance with another preferred embodiment of the present invention.

Figure 10:
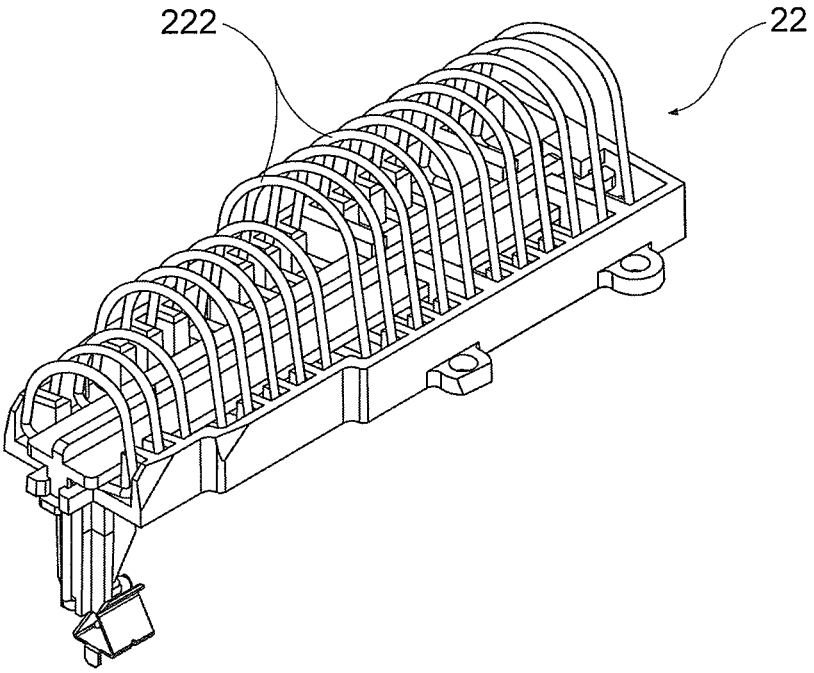

FIG. 10 is a partially perspective view of a shark fin type car antenna assembly in accordance with another preferred embodiment of the present invention.

DETAILED DESCRIPTION OF THE INVENTION

Referring to the drawings and initially to FIGS. 2 and 3, a shark fin type car antenna assembly 2 in accordance with the preferred embodiment of the present invention comprises an outer cover 21, an antenna unit 22, a fixing seat 23, a locking bar 232, a control board 24, a navigation device 240, and a base 25. The base 25 has a tapered shape and has a width that is increased gradually from the front end of the base 25 toward the rear end of the base 25. The base 25 has an interior provided with a first receiving space 251 to receive the control board 24 and a second receiving space 252 to receive the navigation device 240. The fixing seat 23 is located above the base 25. The fixing seat 23 has a hollow inside and has two opposite sides each provided with a plurality of retaining grooves 231 for mounting and positioning the antenna unit 22. The locking bar 232 is locked onto the fixing seat 23 and presses the antenna unit 22 to lock the antenna unit 22 onto the fixing seat 23. The antenna unit 22 is made of a metallic strip which is bent freely to have a determined shape to correspond to the position of the fixing seat 23. The antenna unit 22 has a constant spacing to enhance a gain effect of the AM and FM signals. The antenna unit 22 has a terminal connected with the control board 24 so that the received signal of the antenna unit 22 is transmitted through the control board 24 into a car. The outer cover 21 is mounted on the base 25 to cover the antenna unit 22 and the fixing seat 23. Thus, the car antenna assembly 2 has the shape of a shark fin as shown in FIG. 2. In such a manner, the car antenna assembly 2 reduces the air drag of the car during movement. In addition, the car antenna assembly 2 does not have an elongate extension antenna so that the antenna unit 22 is protected by the outer cover 21 and will not be deformed or broken due to hit, thereby greatly enhancing the lifetime of the car antenna assembly 2.

Referring to FIGS. 4 and 5 with reference to FIGS. 2 and 3, the antenna unit 22 is bent successively and includes a plurality of antenna elements 220 which are connected successively. Each of the antenna elements 220 has a trapezium shape. The antenna elements 220 have a height which is increased gradually from the front end of the antenna unit 22 toward the rear end of the antenna unit 22. The antenna elements 220 are spaced equally from each other, with a constant spacing being defined between any two of the antenna elements 220 to produce an enough bandwidth so that the bandwidth of the antenna elements 220 is increased so as to increase the receiving effect of the AM and FM signals and to reach the optimum gain effect of the antenna elements 220. The constant spacing of the antenna elements 220 is ranged between 3 mm and 5 mm. The antenna elements 220 are inserted into the retaining grooves 231 of the fixing seat 23 so that the antenna unit 22 is positioned onto the fixing seat 23 easily and quickly. The retaining grooves 231 of the fixing seat 23 keep the antenna elements 220 at the constant spacing so that the antenna elements 220 will not be deflected so as to enhance the receiving effect of the antenna unit 22. The height of each of the antenna elements 220 is ranged between 20 mm and 30 mm. Thus, the antenna unit 22 obtains a lower SWR by the height differential of the antenna elements 220 so as to have a better receiving power.

Referring to FIGS. 5 and 6 with reference to FIGS. 2-4, the fixing seat 23 has a front end provided with a fixing recess 234 and a rear end provided with a locking tenon 233. The locking bar 232 has a front end provided with a locking hook 2321 hooked into the fixing recess 234 of the fixing seat 23 and a rear end provided with a fixing mortise 2320 (FIG. 5*a*) for fixing the locking tenon 233 of the fixing seat 23. Thus, the locking bar 232 presses the bottom of each of the antenna elements 220 to lock the antenna elements 220 of the antenna unit 22 onto the fixing seat 23 solidly and stably without producing deflection and vibration.

Referring to FIG. 7 with reference to FIGS. 2-6, the control board 24 has a top provided with a receiving terminal 241, and the front end of the fixing seat 23 is provided with a connecting terminal 235 extended downward and connected with the receiving terminal 241 of the control board 24. In assembly, the control board 24 is received in the first receiving space 251 of the base 25 and is locked by screws, and the navigation device 240 is received in the second receiving space 252 of the base 25 and is locked by screws. Then, the fixing seat 23 together with the antenna unit 22 is placed on the base 25 and located above the control board 24. Then, the connecting terminal 235 of the fixing seat 23 is connected and conducted with the receiving terminal 241 of the control board 24 so that the received signal of the antenna elements 220 is transmitted through the control board 24 into the car to broadcast the AM and FM signals in the car. Finally, the outer cover 21 is mounted on the base 25 to cover the antenna unit 22 and the fixing seat 23. At this time, the fixing seat 23 has a periphery provided with a plurality of positioning holes 236, and the outer cover 21 has an interior provided with a plurality of positioning tubes 210 extended through the positioning holes 236 of the fixing seat 23 and locked onto the base 25 by a plurality of fastening members, so that the outer cover 21 is locked onto the base 25, and the fixing seat 23 is positioned between the outer cover 21 and the base 25. Thus, the car antenna assembly 2 is assembled as shown in FIG. 2.

Referring to FIG. 8 with reference to FIGS. 2-7, the car antenna assembly 2 is mounted on any position of a car 3. Preferably, the car antenna assembly 2 is mounted on the top of the car 3. The car antenna assembly 2 has a shark fin shape and has a sharper front end. The width of the car antenna assembly 2 is increased gradually from the front end of the base 25 toward the rear end of the base 25 so that the car antenna assembly 2 is like an arrow to reduce the air drag and air shear noise of the car during movement so as to provide a comfortable sensation to the driver in the car 3. In addition, the car antenna assembly 2 does not have an elongate extension antenna so that the car antenna assembly 2 will not be hit by an obstruction above the car. Further, the antenna unit 22 is protected by the outer cover 21 and will not be deformed or broken due to hit, thereby greatly enhancing the lifetime of the car antenna assembly 2. Further, the antenna elements 220 are positioned by the retaining grooves 231 of the fixing seat 23 so that the antenna elements 220 are positioned exactly and will not be deflected due to a fast speed of the car so as to enhance the receiving effect of the antenna unit 22. Further, the locking bar 232 presses the bottom of each of the antenna elements 220 to lock the antenna elements 220 of the antenna unit 22 onto the fixing seat 23 solidly and stably without producing deflection and vibration.

Referring to FIG. 9, each of the antenna elements 221 has a hexagonal shape or any polygonal shape.

Referring to FIG. 10, each of the antenna elements 222 has an arcuate shape.

Accordingly, the height of the antenna elements 220 is increased gradually from the front end toward the rear end of the antenna unit 22, while the antenna elements 220 have a constant spacing to produce an enough bandwidth so that the bandwidth of the antenna elements 220 is increased so as to increase the receiving effect of the AM and FM signals and to reach the optimum gain effect of the antenna elements 220. In addition, the antenna unit 22 is retracted inward to shorten the size of the car antenna assembly 2 so that the car antenna assembly 2 will not be hit by an obstruction above the car to prevent the car antenna assembly 2 from being deformed or broken due to hit, thereby greatly enhancing the lifetime of the car antenna assembly 2. Further, the antenna unit 22 is protected by the outer cover 21 and will not be deformed or broken due to hit, thereby facilitating operation of the antenna unit 22. Further, the car antenna assembly 2 has a shark fin shape, and has a width that is increased gradually, so that the car antenna assembly 2 forms an air guidance effect and can eliminate the air shear noise when the car is driven at a higher speed so as to provide a comfortable sensation to the driver in the car 3. Further, the car antenna assembly 2 can reduce the air drag of the car during movement to facilitate movement of the car 3. Further, the antenna elements 220 are positioned by the retaining grooves 231 of the fixing seat 23 so that the antenna elements 220 are positioned exactly and will not be deflected due to a fast speed of the car so as to enhance the receiving effect of the antenna unit 22. Further, the locking bar 232 presses the bottom of each of the antenna elements 220 to lock the antenna elements 220 of the antenna unit 22 onto the fixing seat 23 solidly and stably without producing deflection and vibration.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shark fin type car antenna assembly, comprising:

an outer cover, an antenna unit, a fixing seat, a locking bar, a control board, and a base; wherein:

the antenna unit is locked and positioned in the fixing seat;

the fixing seat is connected with the base;

the outer cover closes the fixing seat and the base;

the antenna unit is made of a metallic strip which is bent freely to form a plurality of antenna elements which are connected successively;

each of the antenna elements has a trapezium shape;

the antenna elements have a height which is increased gradually from the front end of the antenna unit toward the rear end of the antenna unit;

the fixing seat is provided with a plurality of retaining grooves for mounting and positioning the antenna unit;

the antenna elements are inserted into the retaining grooves of the fixing seat;

the antenna elements are spaced equally from each other, with a constant spacing being defined between any two of the antenna elements;

the locking bar is locked onto the fixing seat and presses a bottom of each of the antenna elements to lock the antenna elements of the antenna unit onto the fixing seat;

the outer cover covers the antenna unit and the fixing seat;

the fixing seat has a periphery provided with a plurality of positioning holes; and the outer cover has an interior provided with a plurality of positioning tubes extended through the positioning holes of the fixing seat and locked onto the base, so that the outer cover is locked onto the base, and the fixing seat is positioned between the outer cover and the base.

2. The shark fin type car antenna assembly of claim 1, wherein the height of each of the antenna elements is ranged between 20 mm and 30 mm.

3. The shark fin type car antenna assembly of claim 1, wherein the constant spacing of the antenna elements is ranged between 3 mm and 5 mm.

4. The shark fin type car antenna assembly of claim 1, wherein:

the fixing seat has a front end provided with a fixing recess and a rear end provided with a locking tenon; and the locking bar has a front end provided with a locking hook hooked into the fixing recess of the fixing seat and a rear end provided with a fixing mortise for fixing the locking tenon of the fixing seat.

5. The shark fin type car antenna assembly of claim 1, wherein each of the antenna elements has a hexagonal shape, an arcuate shape or any polygonal shape.

* * * * *